US005727439A

United States Patent [19]

Pelc

[11] Patent Number: 5,727,439

[45] Date of Patent: Mar. 17, 1998

[54] MULTIPLE BOBBIN TATTING SHUTTLE, METHOD OF TATTING AND TATTED ARTICLES

[76] Inventor: Lauren P. Pelc, 410 Chaucer Ct., Schaumburg, Ill. 60193-2720

[21] Appl. No.: 526,804

[22] Filed: Sep. 11, 1995

[51] Int. Cl.[6] ..... D04C 7/00

[52] U.S. Cl. ..... 87/58; 87/52; 87/54

[58] Field of Search ..... 242/588; 87/52, 87/58, 59, 54

[56] References Cited

U.S. PATENT DOCUMENTS

| | | | |
|---|---|---|---|
| 55,254 | 6/1866 | Dobrowsky . | |
| 80,781 | 8/1868 | Stockwell et al. . | |
| 106,415 | 8/1870 | Smith . | |
| 146,077 | 12/1873 | Kellogg . | |
| 1,345,303 | 6/1920 | Wolle | 78/58 |
| 1,452,183 | 4/1923 | Carlson . | |
| 1,473,790 | 11/1923 | Kwapil | 87/59 |
| 1,521,528 | 12/1924 | Grigg . | |
| 5,181,449 | 1/1993 | Winandy | 242/588 |

OTHER PUBLICATIONS

The Lace Adventurer (Beggar's Lace), Jun. 19, 1995, Denver, CO, Photocopy of actual Double Bobbin Shuttle attached. 3 pages.

*Primary Examiner*—William Stryjewski

[57] ABSTRACT

A tatting shuttle for holding multiple thread bobbins on the same shuttle to enable use of more than two colors or textures of thread while tatting. The shuttle uses multiple pairs of facing bobbin holders to hold each respective bobbin between planar shuttle members. The shuttle may include several pairs of bobbin holders. One end of the shuttle may form a point to facilitate tatting and the other end may be a joining member holding the two planar members together. A method for tatting is described in which the shuttle allows one to tat patterns of material in multiple colors or textures by selecting different colored or textured material from respective ones of the bobbins.

4 Claims, 6 Drawing Sheets

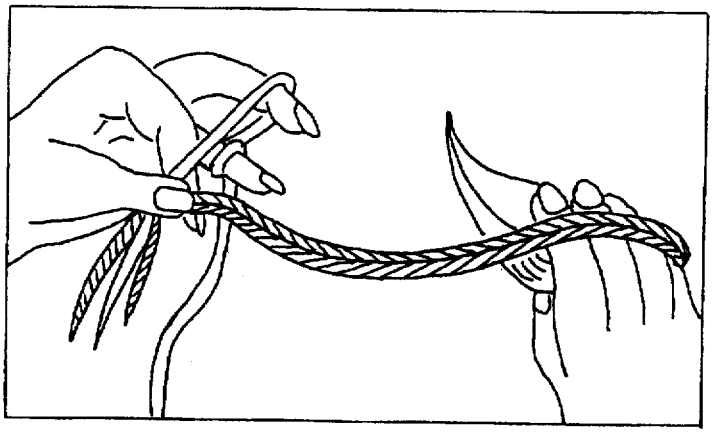
Figure 5
Figure 6
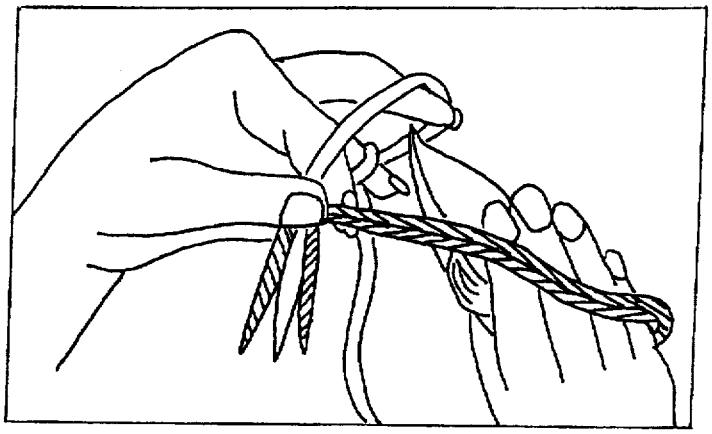
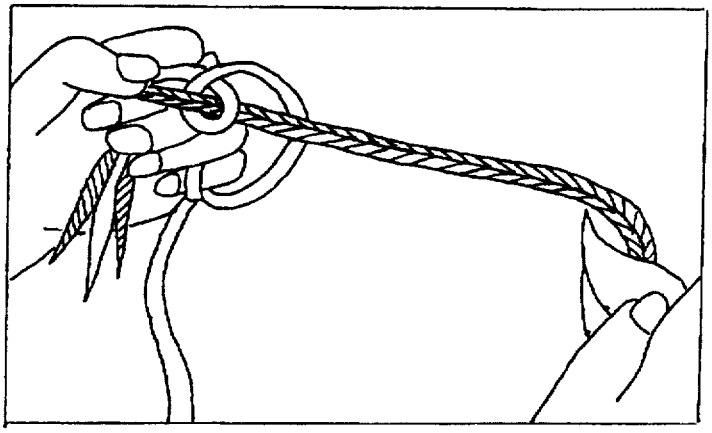
Figure 7

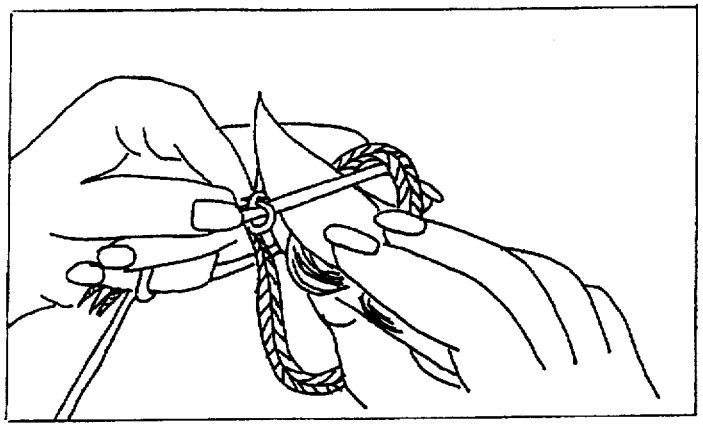
Figure 8
Figure 9
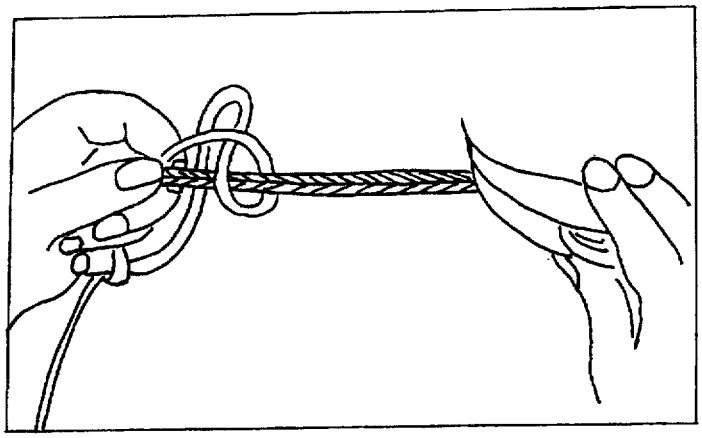
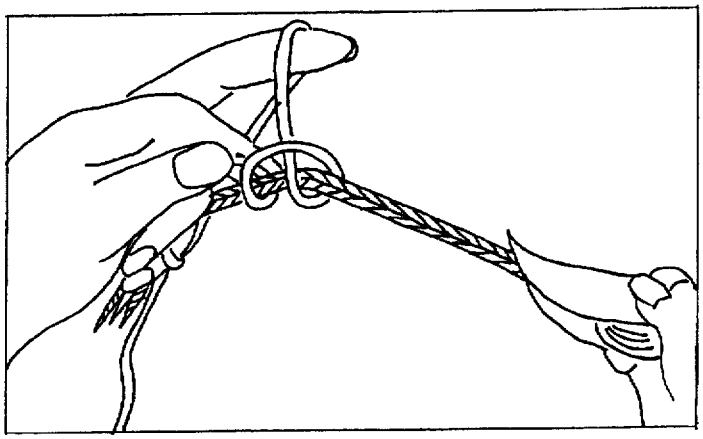
Figure 10

MULTIPLE BOBBIN TATTING SHUTTLE, METHOD OF TATTING AND TATTED ARTICLES

BACKGROUND OF THE INVENTION

This invention relates to the handcraft of tatting, and more particularly to a shuttle for tatting, a new method of tatting using the shuttle, and articles tatted using the novel shuttle and method.

In the handcraft of tatting a plurality of knots of one thread are tied in a prescribed manner on a carrier thread. An improvement in tatting was the introduction of a shuttle to carry the carrier thread and facilitate the making of the specific knots required for the production of a desired pattern. Using a conventional shuttle with one thread and a ball of another thread allows the creation of two color patterns using two threads. However in those situations where a pattern of more than two colors is desired, one thread used for the first color has to be cut and a second thread of the desired second color has to be tied onto one of the existing threads and the tatting continued. This creates a knot which has to be covered by the desired thread color in order to conceal the knot connecting the threads of the different colors within the new pattern.

A desireable feature to the tatter is the ability to use color variation to create an intricate pattern of handwork. The present invention provides a tatting shuttle to allow use of more than two threads, a new method for tatting using more than two threads without requiring cutting any of the threads or tying knots to connect different colored threads, and articles made using the novel shuttle and method.

SUMMARY OF THE INVENTION

The present invention includes a tatting shuttle with a plurality of bobbin holders, a method of tatting using more than two threads to allow making patterns in three or more colors without requiring cutting and tying at each change of colors, and a tatted article of three or more uninterrupted threads.

BRIEF DESCRIPTION OF THE DRAWING

FIGS. 5–10 show schematic views of steps of a novel method of tatting using the shuttle of FIG. 1.

DESCRIPTION OF THE PREFERRED EMBODIMENTS AND BEST MODE

For convenience the description of the invention will refer to the use of thread. It should be understood that within the scope of the present invention any flexible, elongated material, such as yarn, string, rope or similar material may be used to make a pattern with a shuttle of suitable size. It should also be understood that "chain" is used hereinafter to refer to a sequence of consecutive knots along carrier threads in a pattern, and "loop" is used hereinafter to refer to a sequence of consecutive knots around a ring of carrier thread.

Figure 1:
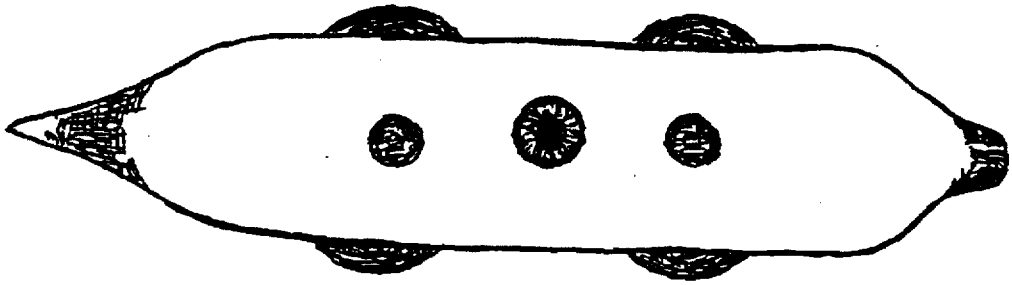
FIG. 1 shows a schematic plan view of one preferred embodiment of the tatting shuttle of the present invention.
Figure 2:
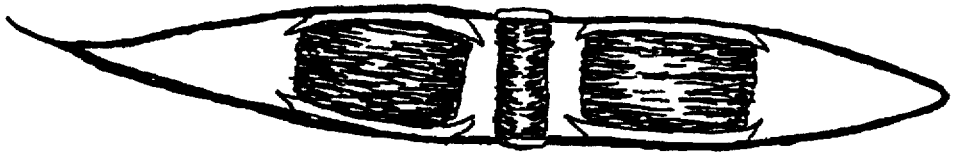
FIG. 2 shows a schematic side view of the shuttle of FIG. 1.
Figure 3:
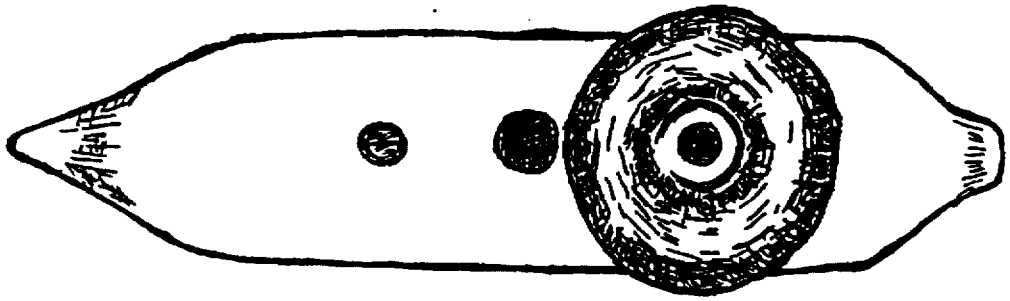
FIG. 3 is a schematic partial plan view of one side of the tatting shuttle of FIG. 1.

The tatting shuttle 10 of the present invention includes a top plate 12 and a bottom plate 14 of metal, plastic or other suitable material, joined at the respective ends by suitable means, for example, a rivet, adhesive, or compression lock mechanism, in the particularly preferred embodiment shown in FIGS. 1–3, the top and bottom plates may be joined by virtue of being made of a single planar member folded at an approximate midpoint to form one end 16 and joined, for example, by deformation, adhesive or other suitable means at the mated ends as shown in FIG. 2 to form the opposite end 18. At end 38 of the shuttle a point 20 may be provided to facilitate passage of the shuttle through a picot in the thread for joining at a picot. A picot, is a loop of thread between two stitches in a pattern. A rivet 22 may be used to secure the approximate centers of the top and bottom plates at a desired spacing. Two pairs of facing, opposed projections 24 as shown in FIG. 3 are provided on the inner surfaces 13, 15 of the top and bottom plates 12 and 14, respectively, to provide positioning and frictional retention of thread bobbins 26, 28 in the shuttle.

As shown in FIG. 5, in making a chain using the shuttle 10 in the method of the present invention, a loop 30 of a first thread 32 is held around the left hand 34 of the tatter. Second and third threads 36, 38 are held on bobbins 26, 28 (as shown in FIGS. 1 and 2) on the shuttle held in the right hand 40 of the tatter. To form the first half of the knot, the shuttle 10 is passed inside the loop 30, under portion 30*a*of thread 32 as shown in FIG. 6 at the position 42 between the fingers 44, 46 and then around the upper portion 30*a* of thread 32 to form a loop 50 as shown in FIG. 7 in thread 32. Thread 32 is wrapped around finger 48 to allow the tatter to maintain proper tension in thread 32 during tatting by controlling the position of finger 48. The second half of the knot is formed as the shuttle 10 is passed over the portion 30*a* of thread 32 and then back through the loop 30 as shown by arrow 51 in FIG. 8 to create a second loop 52 shown in FIG. 9 in thread 32. Loop 52 is then slid along threads 36, 38 until it is adjacent loop 50 as shown in FIG. 10. In this fashion, a slip knot comprising loops 50 and 52 is formed in thread 32 around threads 36, 38. This process is repeated to form enough adjacent knots to complete a desired pattern known as a "chain" 60 as shown, for example, in FIG. 11.

Figure 11:
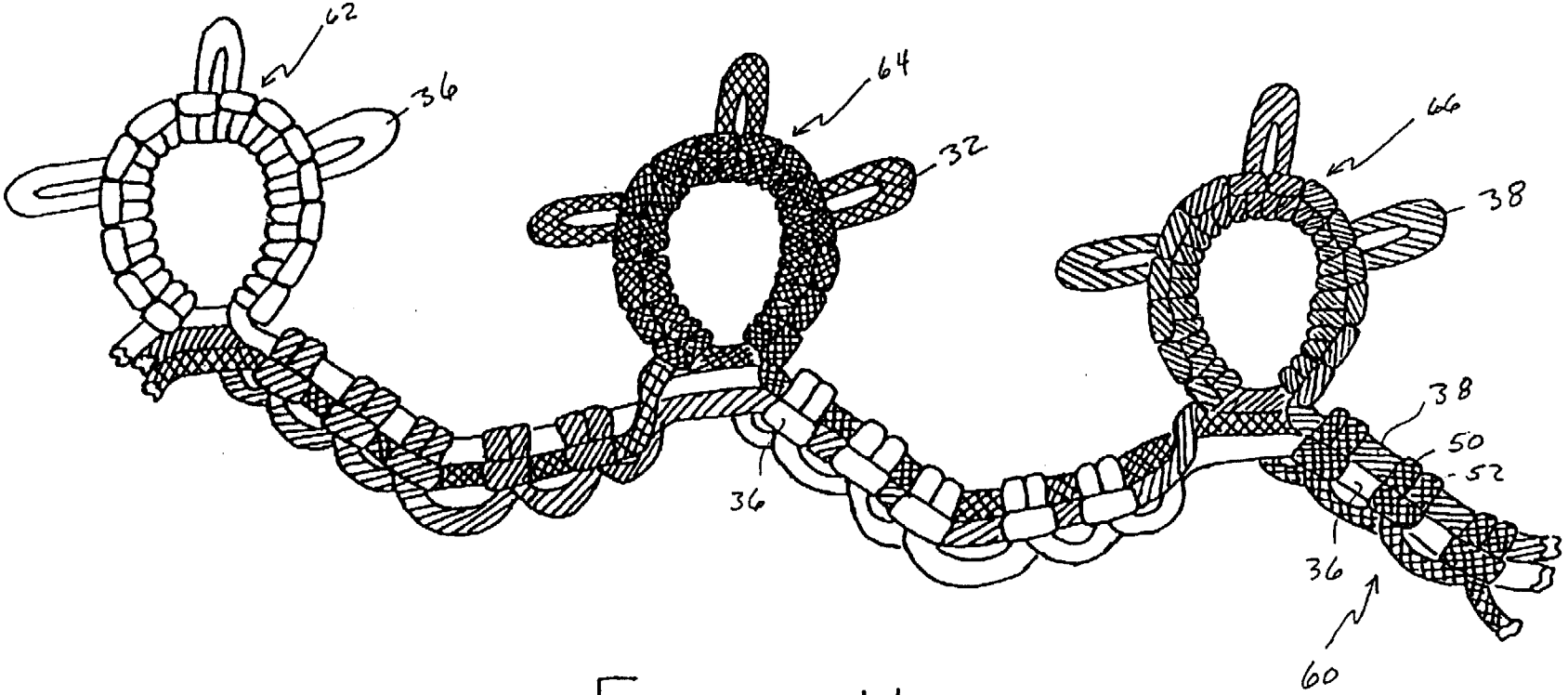
FIGS. 11 and 12 show articles having patterns of tatted lace of three colors made by the method of the present invention, using the tatting shuttle of FIGS. 1–3.

The sequence of steps described above differs from that used in conventional tatting to form a chain in that two carrier threads 36, 38 are used instead of one, both of which threads 36, 38 are carried on shuttle 10. All three threads are available to form a sequence of rings 62, 64 and 66 as shown in FIG. 11 of any pattern of the three colors in the chain. To form a ring one bobbin, for example 26, is removed from the shuttle, so that the single thread on the bobbin remaining in the shuttle, 28, may be used as the carrier around which a series of knots are tied of the other thread 32.

When the ring 62 is completed, two bobbins are mounted in the tatting shuttle and the third thread is used to make another section of chain 60, as described above. If the thread 32 is also wound on a bobbin, any of the threads on any one of the bobbins may be used to form the chain. If two bobbins are used with the third thread color on a ball, spool, or other holder, that third thread will form all the knots visible in the chain 60. It will be understood that in the method using three bobbins any of the three threads may be used for the chain as illustrated in FIG. 11. The bobbins may be switched whenever a change of color is desired to create an alternating pattern of the three colors of the three threads. Also when another ring 64 or 66 is made, it may be of any one of the three threads, allowing intricate multicolor patterns of tatted shapes.

Figure 12:
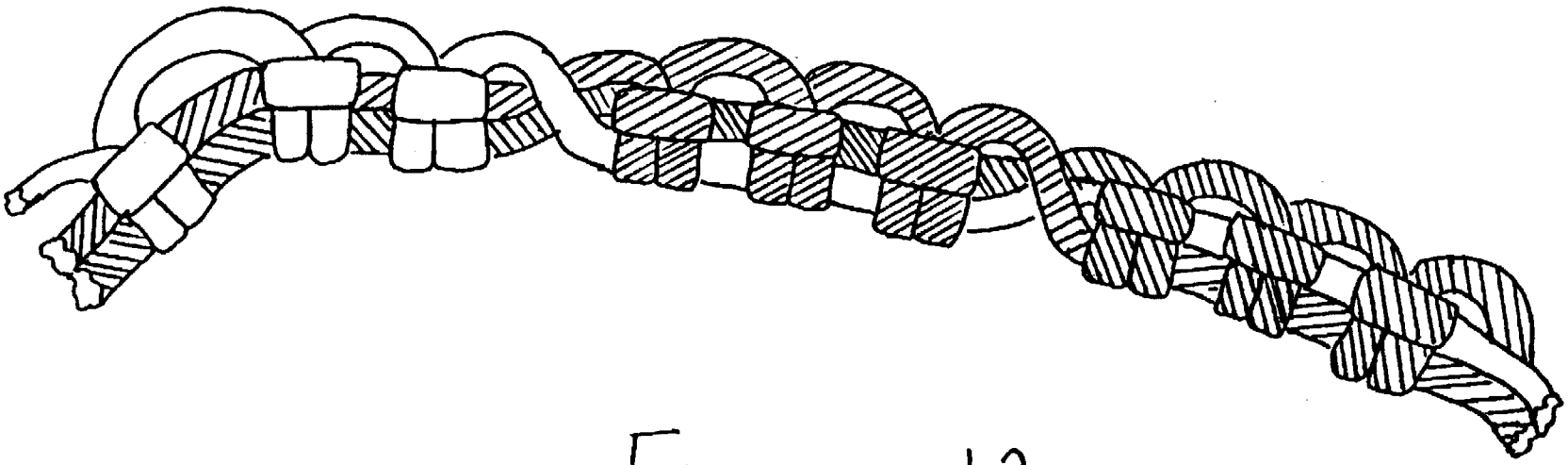

The bobbins may also be switched to create a chain having each of the three colors exposed in any desired pattern as shown in FIG. 12.

Figure 4:
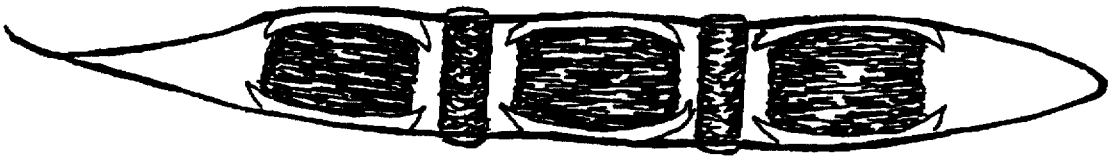
FIGS. 4 is a schematic side view of an alternative embodiment of the present invention.

A shuttle of the type of present invention can be made to hold more than two bobbins. For example, as shown in FIG. 4, a shuttle 70 holding three bobbins 72, 74, 76 may be used. Such a design allows four colors, three on the bobbins in the shuttle and a fourth color on a separate bobbin or in a ball, to be produced in the chain pattern with three threads being used as the carrier in the method of the present invention. This results in a thicker carrier, but the extra thickness is not normally a concern with threads. A shuttle holding additional bobbins could be used, but as bobbins are added the shuttle would become bulkier, and tatting would be more difficult. However, it would enable creating increasingly intricate patterns using as many colors as desired without adding unwanted knots.

I claim:

1. A tatting shuttle comprising:

a first generally elongated member having a first generally planar inner face, said inner face having a first plurality of bobbin holders thereon; and a second generally elongated member attached to said first member and having a second generally planar inner face disposed generally in parallel to said first generally planar inner face, said second generally planar inner face having a second plurality of bobbin holders thereon disposed generally in aligned opposition to said first plurality of bobbin holders; such that respective ones of said first and second inner pluralities of bobbin holders are disposed in general opposition to each other to form respective opposed pairs of bobbin holders for holding each respective bobbin of a plurality of bobbins in position between a respective pair of opposed bobbin holders between said inner faces.

2. The tatting shuttle of claim 1, further comprising;

a point disposed at one end of one of said elongated members; and a joining member disposed at the opposite end of said elongated members for holding said elongated members in spaced generally parallel relationship.

3. The invention of claim 1 wherein each of said first and second pluralities of bobbin holders comprises two projections extending respectively from each of said first and second inner faces disposed in alignment to form respective pairs of opposed projections forming two frictional bobbin retainers between said inner faces.

4. A tatting shuttle comprising:

a first generally elongated member having a first generally planar inner face, said inner face having a first plurality of bobbin holders thereon;

a second generally elongated member attached to said first member and having a second generally planar inner face disposed generally in parallel to said first generally planar inner face, said second generally planar inner face having a second plurality of bobbin holders thereon disposed generally in aligned opposition to said first plurality of bobbin holders; such that respective ones of said first and second inner pluralities of bobbin holders are disposed in general opposition to each other to form respective opposed pairs of bobbin holders for holding each respective bobbin of a plurality of bobbins in position between a respective pair of opposed bobbin holders between said inner faces; and wherein each of said first and second pluralities of bobbin holders comprises three projections extending respectively from each of said first and second inner faces disposed in alignment to form three pairs of opposed projections forming three frictional bobbin retainers between said inner faces.

* * * * *